US005603787A

United States Patent [19]

Reid

[11] Patent Number: 5,603,787

[45] Date of Patent: Feb. 18, 1997

[54] DRAIN BACK CONTAINER ASSEMBLY

[75] Inventor: Grahame W. Reid, Novato, Calif.

[73] Assignee: Innovative Molding, Inc., Sebastopol, Calif.

[21] Appl. No.: 470,920

[22] Filed: Jun. 6, 1995

Related U.S. Application Data

[62] Division of Ser. No. 176,951, Dec. 31, 1993, Pat. No. 5,431,306.

[51] Int. Cl.[6] ..... B67D 1/16

[52] U.S. Cl. ..... 156/73.1; 156/69; 156/293; 222/111; 222/571

[58] Field of Search ..... 156/69, 73.1, 293, 156/294, 308.4; 222/108, 109, 111, 424, 551, 568, 571

[56] References Cited

U.S. PATENT DOCUMENTS

| | | | |
|---|---|---|---|
| 2,448,569 | 9/1948 | Allen . | |
| 2,601,040 | 6/1952 | Livingstone . | |
| 2,715,480 | 8/1955 | Livingstone . | |
| 3,628,697 | 12/1971 | Dowson . | |
| 3,899,096 | 8/1975 | Marco . | |
| 4,128,189 | 12/1978 | Baxter . | |
| 4,341,317 | 7/1982 | Suzuki et al. . | |
| 4,550,862 | 11/1985 | Barker | 222/571 |
| 4,671,421 | 6/1987 | Reiber | 222/109 |
| 4,696,416 | 9/1987 | Muckenfuhs | 222/109 |
| 4,746,025 | 5/1988 | Krautkramer | 156/73.1 |
| 4,802,597 | 2/1989 | Dubach . | |
| 4,836,419 | 6/1989 | Metz et al. . | |
| 4,863,067 | 9/1989 | Krall | 222/571 |
| 4,890,768 | 1/1990 | Robinson . | |
| 4,890,770 | 1/1990 | Haga | 222/109 |
| 4,892,126 | 1/1990 | Bucheler et al. . | |
| 4,917,268 | 4/1990 | Campbell | 222/109 |
| 4,917,269 | 4/1990 | Fuchs et al. . | |
| 4,917,270 | 4/1990 | Simon | 222/111 |
| 4,989,757 | 2/1991 | Krall . | |
| 5,207,356 | 5/1993 | Krall . | |
| 5,234,130 | 8/1993 | Benoiff et al. . | |

FOREIGN PATENT DOCUMENTS

| | | |
|---|---|---|
| 0348102 | 12/1989 | European Pat. Off. . |
| 3820428A | 2/1989 | Germany . |

*Primary Examiner*—Daniel Stemmer
*Attorney, Agent, or Firm*—Thomas M. Freiburger

[57] ABSTRACT

A plastic container for pourable liquids such as detergents has a drain back feature and has an internal thread for receiving an externally threaded cap which also serves as a measuring cup for the liquid. The container is formed in two pieces, a container body and a separately formed pour spout component which is assembled to the container finish preferably by ultrasonic welding. In preferred embodiments a lip of the pour spout component is pressed and welded down onto an annular top surface of the container finish, or down into an annular recess on the container finish. The ultrasonic welding operation is accompanied by motion and pressure, simultaneously deforming and welding the top edge of the pour spout component wall down onto the container finish, so that the connection forms a liquid tight seal.

3 Claims, 3 Drawing Sheets

DRAIN BACK CONTAINER ASSEMBLY

This is a division of application Ser. No. 176,951, filed on Dec. 31, 1993, now U.S. Pat. No. 5,431,306.

BACKGROUND OF THE INVENTION

The invention relates to liquid containers, and in particular the invention is directed to a liquid container having a pour spout with a drain back feature, whereby a closure cap serves as a measuring cup and provision is made for return of dripping liquid from the pour spout and from the cap back into the container body.

Drain back type liquid containers are known. As examples, see U.S. Pat. Nos. 5,696,416, 5,207,356, 4,989,757, 4,917,270, 4,917,269, 4,917,268, 4,892,126, 4,890,770, 4,890,768, 4,863,067, 4,836,419, 4,802,597, 4,671,421, 4,550,862, 4,128,189, 3,628,697, 2,715,480, 2,601,040 and RE 24,159.

One reference listed above, Barker U.S. Pat. No. 4,550,862 discloses a drain back container of the general type to which this invention is directed, suited particularly for liquid detergents and provided with an externally threaded cap which serves as a measuring cup for the detergent. However, a pour spout component in the preferred embodiment of the Barker patent is secured to the blow molded plastic container by a threaded connection, a connection which differs from that of the present invention and involves more complex molding and assembly. It is an object of this invention to provide an improved construction of a liquid drain back container wherein a pour spout component is assembled to the blow molded container body in a unique and advantageous manner.

SUMMARY OF THE INVENTION

The drain back container of the invention has a plastic pour spout component or drain back component which is secured to the blow molded container body preferably by ultrasonic bonding. The drain back component has a pour spout extending to a position above the container finish, the pour spout being surrounded by an annular, angled trough which has a deep side and a shallow side. In the deep side is a liquid drain back hole, preferably extending up the wall of the trough somewhat for optimum drainage of liquid back into the container. At the top of an outer wall of the pour spout component, i.e. the wall forming the outer side of the annular trough, is an annular lip or flange which preferably extends upwardly in the form in which the pour spout component is injection molded, prior to assembly onto the container finish. Upon assembly of the two parts together, an ultrasonic welding horn is pushed down against this lip or flange with force, causing the flange to be deformed downwardly and preferably into a recess at the top of the container finish. This causes the two plastic parts, which are melt-flow compatible, to be intimately bonded together in a liquid tight connection of high integrity. The use of such a step or recess in the container finish, at the position where the deformable flange of the spout component will be bonded, assures a better connection between the two components, particularly when they are of plastic materials such as polyethylene.

In other embodiments of the invention the sonic-bonded connection between the lip of the pour spout component and the top of the container finish is modified somewhat. In one form the lip simply deforms down onto and bonds to a flat ledge at the top of the container finish. In another the lip is initially formed as a radial flange extending slightly outwardly, and on ultrasonic bounding is deformed inwardly/downwardly into a recess at the upper/outer side of the container finish. The upper edge of the container finish is also deformed in the operation.

It is therefore among the objects of the invention to improve over prior configurations of pour spout/drain back containers for liquids such as detergents, through a process and a resulting connection which is relatively simple, of high strength and liquid tight integrity, and which provides a neat and finished appearance at the joint between the pour spout component and the container body. These and other objects, advantages and features of the invention will be apparent from the following description of a preferred embodiment, considered along with the accompanying drawings.

DESCRIPTION OF THE DRAWINGS

FIG. 4 shows components before bonding, while FIG. 5 shows them being bonded ultrasonically.

DESCRIPTION OF PREFERRED EMBODIMENTS

Figure 1:
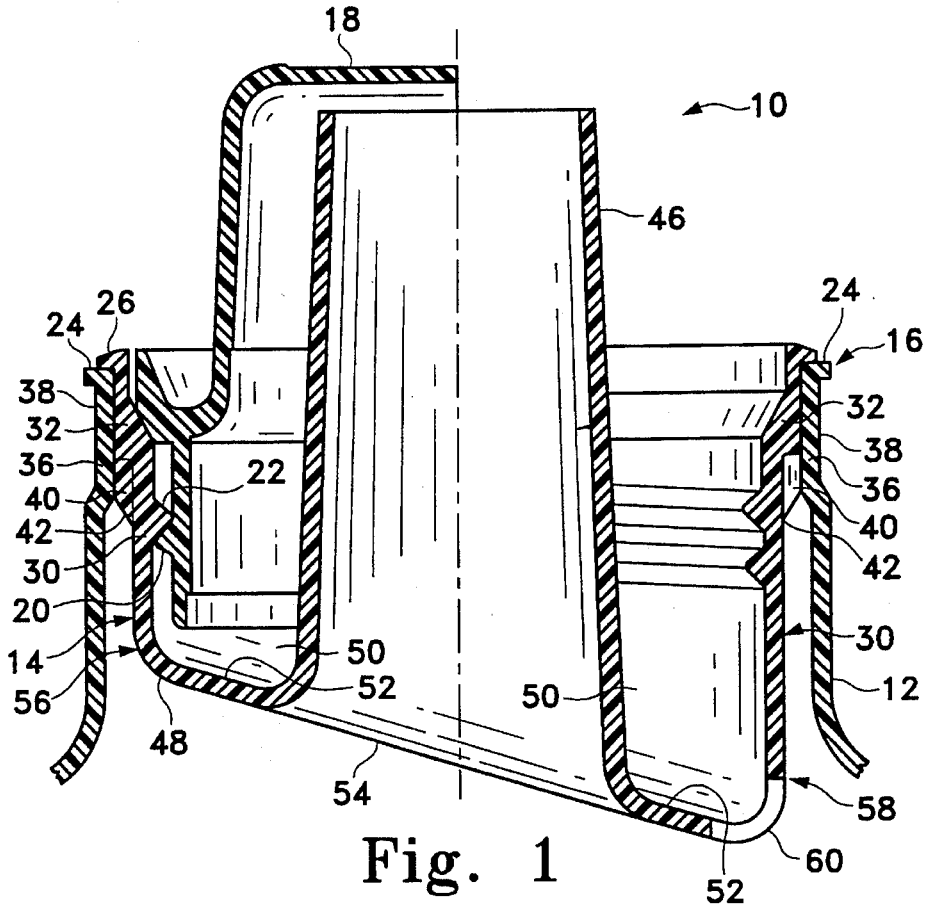
FIG. 1 is a sectional view in elevation showing a portion of one preferred form of drain back container and closure of the invention.
Figure 1A:
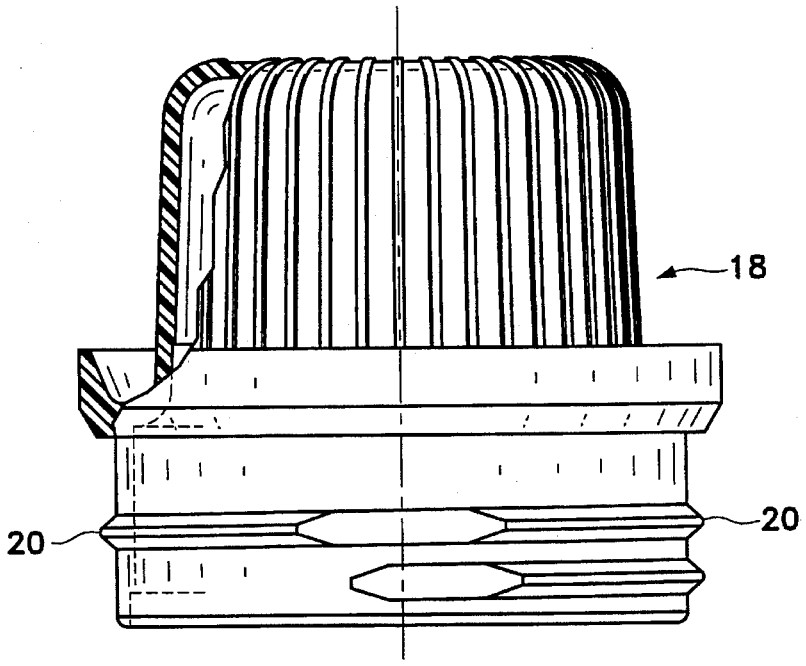
FIG. 1A is an elevation view, partially in section, showing the closure.
Figure 2:
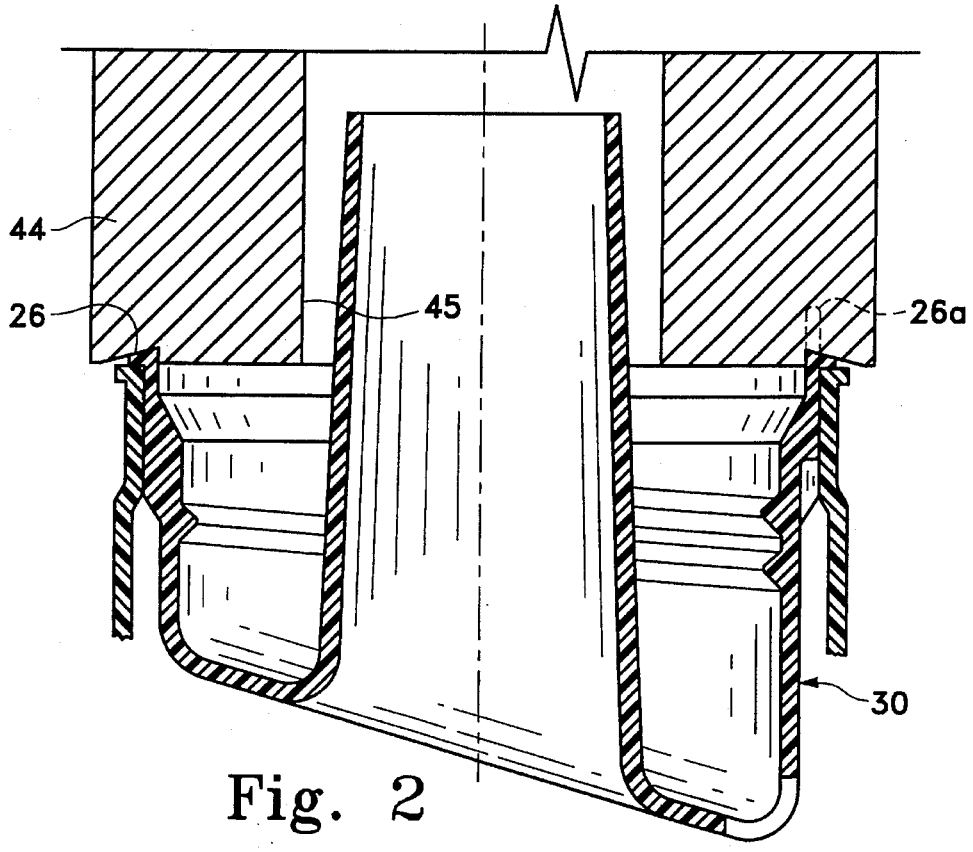
FIG. 2 is a detail view in sectional elevation showing the ultrasonic bonding of a drain back component to a container body as in FIG. 1.

FIG. 1 shows a drain back container/cap assembly 10 in accordance with one preferred embodiment of the invention. The assembly 10 includes a plastic container body, preferably a blow molded container body 12 the upper portion of which is seen in FIG. 1, with a pour spout component 14 secured to an upper open end or finish 16 of the container body. A closure 18 of the assembly, the left side of which is shown in FIG. 1, has an external thread 20 and a hollow interior so as to act as a measuring cup, such as for liquid detergent which might be carried in the container. FIG. 2 also shows the closure or cap 18. The external thread 20 engages an internal thread 22 formed at the inside of the pour spout component.

Container assemblies of this general type have been known. For example, in one such prior assembly a drain back pour spout component was secured to the finish of a blow molded container by "spin welding", by which the pour spout component was rotated rapidly to create heat from friction, ultimately bonding the plastics together. Such a construction was disclosed in U.S. Pat. No. 4,671,421 cited above. This invention provides a better connection between the pour spout component and the blow molded container, both of which may be formed of polyethylene, by forming a connection which is of high strength and liquid sealing integrity, and also which has a better and more finished appearance at the visible joint.

To this end, in accordance with the present invention, the drain back spout component 14 is assembled onto the top of the container finish 16, rather than lapping over and down the outside of the container finish to a connection on the outside of the container. The assembly method avoids any irregular or unsightly joint between the two components while still providing a high integrity, liquid tight joint.

One preferred embodiment having this construction is shown in FIG. 1. The container finish 16 has an upper edge 24 upon which rests an annular flange 26 of the pour spout component 14, as shown. The upper edge 24 of the container finish which is itself an annular flange may extend radially outwardly as shown, forming a ledge surface upon which the flange 26 of the pour spout component rests. Below this connecting flange 26 of the pour spout component is a wall 30 of the pour spout component, having a collar portion 32 which is of a diameter to be closely fitted within the finish of the container. As indicated, the container finish 16 may have a decreased-diameter band 36 which not only receives the collar 32 of the pour spout component wall 30 smoothly on assembly, but which also has an exterior surface 38 configured to be engaged conveniently by a jig or other clamping device during the assembly process.

The wall 30, at the bottom of the collar portion 32, may have a series (e.g. about 4 to 12) of depending guide ribs 40, each having an angled lower side 42, for guiding the pour spout component 14 smoothly into the container on assembly and for helping secure the pour spout component in proper orientation.

In this preferred embodiment, the sealed connection between the component 14 and the container 12 is made via the flange 26 at the top of the pour spout component wall and the top annular edge or ledge 24 of the container finish 16 (some sealing also occurs between the contacting surfaces of the components 32 and 36 below the flange 26. This connection is advantageously made by ultrasonic bonding of the two plastic components, by pushing a sonic bonding horn 44 down with pressure against the flange 26 as shown in FIG. 2, causing it and the top edge of the container finish to heat up and become fused together in sealed relationship around the annular connection. The flange 26 preferably is formed initially, in the injection molding process, as an upward extension **26*a* of the wall 30 (more specifically of the collar 32). FIG. 2 shows a central clearance hole or recess 45 in the ultrasonic horn 44, for clearance over a pour spout of the component 14**, described below.

As shown in FIG. 1, the pour spout component 14 includes an upwardly extending pour spout 46, generally cylindrical or slightly tapered in shape. This is formed integrally with the wall 30. As shown, the wall extends downwardly and then inwardly at 48 to form a trough 50, the bottom 52 of which preferably lies generally within or along an inclined plane as shown at 54. Thus, the trough has a high side 56 and a low side 58, the latter having a drain back opening 60 at the lowest point. In a preferred embodiment of the invention, this drain back hole 60 extends up the wall somewhat, for optimum draining, particularly of relatively viscous liquids.

The wall 30, at the inner side of the annular trough 50, turns upwardly to form the pour spout 46 as illustrated.

Figure 3:
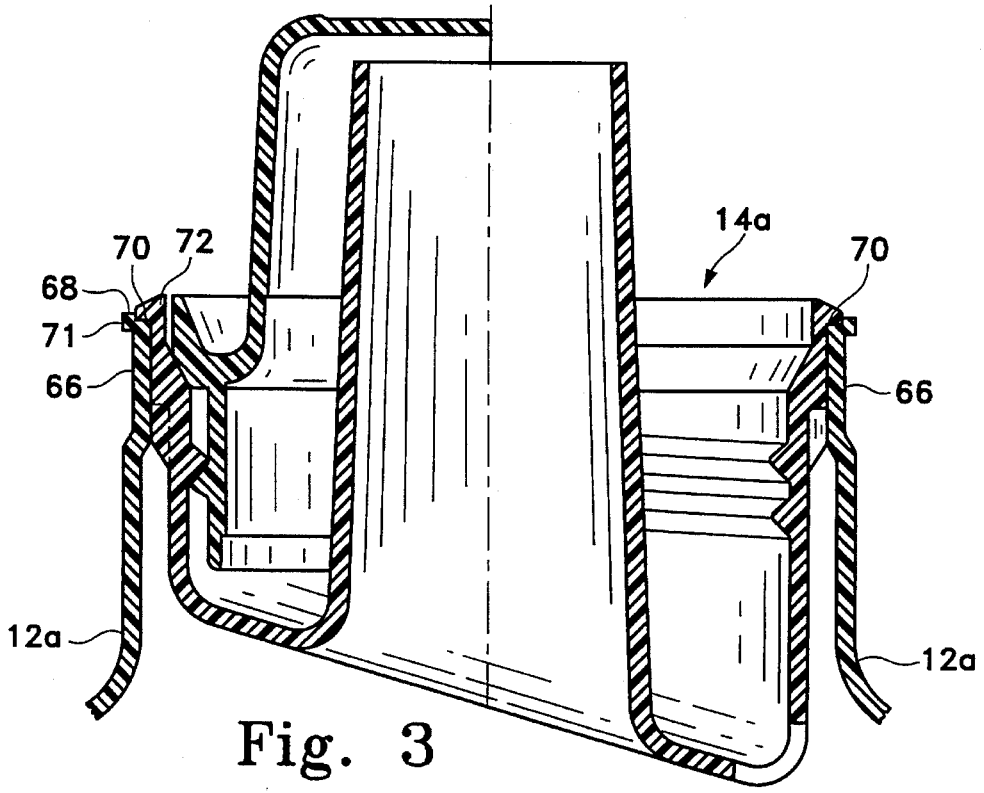
FIG. 3 is a view similar to FIG. 1, showing a second preferred embodiment of the invention.

FIG. 3 shows another preferred embodiment of the invention wherein the connection between the pour spout component **14*a* and the blow molded container body 12*a*** is made in a somewhat different manner.

In FIG. 3 the container body **12*a* has a finish 66 with an upper edge 68 which has an annular recess 70 at the inner side as shown, formed in an annular ledge 71. The annular recess 70 is positioned and sized to receive an annular lip 72 at the top outer edge of the pour spout component, when the lip 72 is deformed and pressed downwardly/outwardly during the bonding operation, generally as in FIG. 2. This operation preferably is accomplished by ultrasonic bonding. With pressure on the ultrasonic horn or platen (as in FIG. 2), the lip 72 bends outwardly, generally radially outwardly, to nest in the annular recess 70** and thoroughly to fuse to the container finish in a liquid tight seal.

As can be seen from FIG. 3, this form of assembly tends to optimize the appearance of the assembled container by essentially hiding much of the seam between the two components or concealing any rough edges by running the extreme edge of the lip 72 into the inner wall of the recess 70 of the container finish. The container finish with recess 70 shown in FIG. 3 is somewhat difficult to achieve with accuracy in certain blow molding machines. The type of assembly construction shown in FIGS. 1 and 2 discussed above, as well as that of FIGS. 4 and 5 to be discussed below, tends to be more accurately achieved on a wide variety of blow molding machines.

Figure 4:
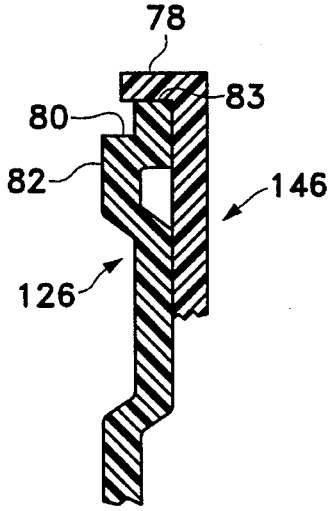
FIGS. 4 and 5 are partial views in cross section, showing an assembly and detail according to a third preferred embodiment of the invention.
Figure 5:
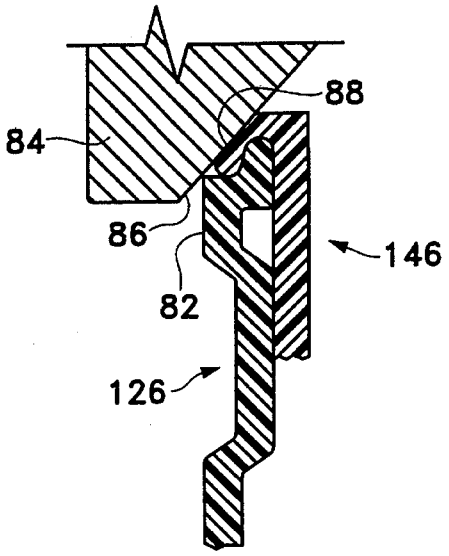
Figure 6:
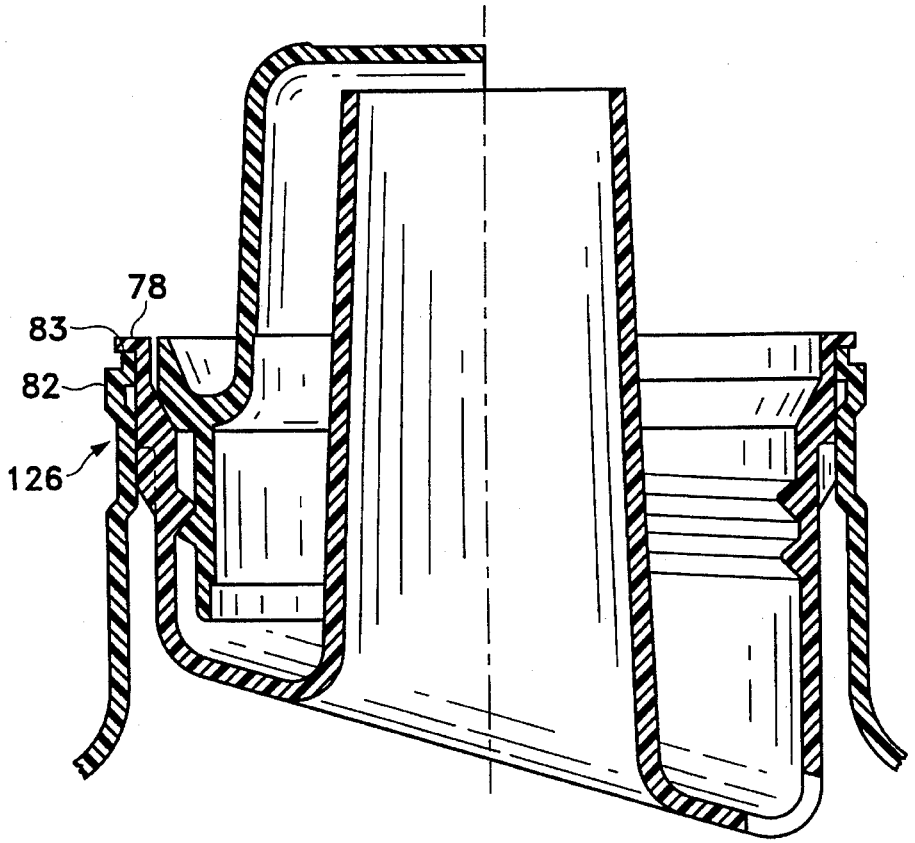
FIG. 6 is an elevation view similar to FIGS. 1 and 3, showing a drain back container and closure assembly configuration which are detailed in FIGS. 4 and 5.

FIGS. 4 and 5 show schematically, in partial cross section views, another form of assembly of a pour spout component **14*b* to a blow molded container body 12*b* which is similar to but slightly different from the constructions described above. These views should be considered along with FIG. 6, a view showing the container finish and the entire pour spout component for this same assembly configuration. In FIG. 5 the assembly is shown prior to ultrasonic welding. The details of FIG. 4 also show the components 12*b*, 14*b* prior to ultrasonic welding. The pour spout component has a radial, horizontal flange or lip 78 slightly positioned to overhang an external notch 80 at the upper end surface of the container finish 82, in a stepped configuration which includes an upper flat surface 83 inward of the notch or recess 80. Thus, the top of the container finish comprises a ledge including the top surface 83 and the recess 80. In FIG. 5 an ultrasonic horn or platen 84 is indicated schematically as being conically shaped at its contacting surface 86. As indicated, this has the effect of deforming a lip extremity 88 of the spout component 14*b* downwardly and inwardly, to nest in and essentially fill the outer annular recess 80 on the upper edge of the container finish. At the same time, the rectangularly stepped cross section of the container finish shown in FIG. 4 is also deformed by the heat and pressure of the ultrasonic horn 84, to the ramped or beveled shape shown in FIG. 5**, adding to the fusing between the surfaces. This type of operation is disclosed generally in U.S. Pat. No. 4,411,720, and it has the effect of producing a neatly finished appearance at the outside of the completed container assembly, while still forming a high-integrity, water tight joint very efficiently.

The material from which the pour spout component is made, for all the above embodiments, preferably is polyethylene. The type of polyethylene selected must be compatible melt-flow wise with the blow molded container, which typically is made from a different polyethylene resin from that of the injection molded pour spout component.

The above described preferred embodiments are intended to illustrate the principles of the invention, but not to limit its scope. Other embodiments and variations to these preferred embodiments will be apparent to those skilled in the art and may be made without departing from the essence and scope of the following claims.

I claim:

1. A method for assembling a blow-molded plastic container body to a separately formed pour spout component having a drain back feature and having an internal thread for receiving an externally threaded cap, comprising:

blow-molding the plastic container body to have an open upper end, terminating in a finish, separately forming a pour spout component, to have an outer periphery with a collar sized to fit closely within the finish of the container body, including forming a wall on the pour spout component which includes said collar and extends down from the collar so as to extend into the container body upon assembly, the wall turning inwardly and upwardly to form a pour spout, the upper end of which is above the collar and the wall thus forming an annular trough around the spout at a base of the spout, the trough being inclined so as to have a deeper side and a shallower side, with a liquid drain back opening through the trough at a deepest point on the deeper side of the trough, and including forming an internal thread on the inner surface of the wall of the pour spout component, positioned to receive external threads of an externally threaded cap, assembling the pour spout component into the plastic container body such that the collar of the pour spout component contacts the inside surface of the container body finish, the pour spout component having a radial lip at the top of the collar which upon assembly rests on an annular ledge at the upper end of the container body finish, and bonding the pour spout component to the container body finish in a liquid-tight seal, by ultrasonically welding the radial lip of the pour spout component downwardly against the annular ledge so as to partially melt the radial lip and the annular ledge and to fuse them together.

2. The method of claim 1, wherein the annular ledge of the container body finish is formed in a stepped configuration with an outer annular recess so that the ledge is stepped downwardly from the inner side to the outer side of the finish, and including, in said bonding step, deforming the radial lip of the collar during ultrasonic welding downwardly and inwardly on the ledge so as to substantially fill the outer annular recess.

3. The method of claim 2, further including, in said bonding step, deforming during ultrasonic welding the lip of the collar and the ledge of the container body finish together so as to form a ledge portion which is inclined downwardly and outwardly with the lip, the lip being bonded to the ledge portion.

* * * * *